US006166896A

United States Patent [19]

Schmitz

[11] Patent Number: 6,166,896

[45] Date of Patent: Dec. 26, 2000

[54] METHOD OF INCREASING THE CAST-OFF SPEED OF THE ARMATURE IN AN ELECTROMAGNETIC ACTUATOR

[75] Inventor: Günter Schmitz, Aachen, Germany

[73] Assignee: FEV Motorentechnik GmbH, Aachen, Germany

[21] Appl. No.: 09/438,363

[22] Filed: Nov. 12, 1999

Related U.S. Application Data

[63] Continuation of application No. 09/332,873, Jun. 15, 1999.

[30] Foreign Application Priority Data

Jun. 15, 1998 [DE] Germany ..... 198 26 569
May 12, 1999 [DE] Germany ..... 199 21 938

[51] Int. Cl.[7] ..... H01H 47/06

[52] U.S. Cl. ..... 361/187; 361/155; 361/194

[58] Field of Search ..... 361/152, 154, 361/155, 156, 187, 194, 205; 123/490

[56] References Cited

U.S. PATENT DOCUMENTS 4,453,652 6/1984 Merkel et al. ..... 361/154
5,748,433 5/1998 Schrey et al. ..... 361/195

*Primary Examiner*—Ronald W. Leja
*Attorney, Agent, or Firm*—Venable; Gabor J. Kelemen

[57] ABSTRACT

A method of increasing a cast-off speed of an armature from a pole of an electromagnet of an electromagnetic actuator, includes the following steps: holding the armature at the pole against a force of a resetting device by maintaining an electric holding current flow through a coil of the electromagnet; and launching the armature from the pole by switching off the holding current; and at a predetermined moment during a release period of the armature from the pole, passing a cast-off current for a predetermined period through the coil. The cast-off current has a polarity opposite to the polarity of the holding current.

4 Claims, 4 Drawing Sheets

METHOD OF INCREASING THE CAST-OFF SPEED OF THE ARMATURE IN AN ELECTROMAGNETIC ACTUATOR

CROSS REFERENCE TO RELATED APPLICATION

This application is a continuation of co-pending U.S. application Ser. No. 09/332,873, filed Jun. 15, 1999.

This application claims the priority of German Application Nos. 198 26 569.7 filed Jun. 15, 1998 and 199 21 938.9 filed May 12, 1999, which are incorporated herein by reference.

BACKGROUND OF THE INVENTION

Electromagnetic actuators as used, for example, for operating cylinder valves in piston-type internal-combustion engines, have at least one electromagnet which exerts an electromagnetic force on an armature supported by resetting means and moving a setting member. The energized holding magnet holds the armature in one of its operational positions so that by de-energizing the holding magnet the armature is moved into its other operational position by the resetting means.

In actuators which are used for operating cylinder valves constituting the setting members, the course of the current control has a significant influence on the various parameters, for example, the condition of the combustion mixture in the intake zone, the condition in the combustion chamber as well as in the exhaust region and furthermore significantly affects the combustion process itself in the combustion chamber. Since the internal-combustion engines operate in a non-stationary manner in widely varying operational conditions, a correspondingly variable and adaptable control of the cylinder valves is necessary.

A significant problem in the control of an electromagnetic setting device of the above-outlined type resides in the required timing accuracy and, connected therewith, in the energy consumption as it is particularly required in case of a load-dependent engine-output control effected by the intake valve actuation. A precise control of the timing is made more difficult because of manufacturing tolerances, wear phenomena occurring during operation, and various operational conditions, such as changing load requirements and working frequencies since these external influences affect time-relevant parameters of the system.

A significant problem in an electromagnetic setting device of the above-outlined type is the sticking of the armature to the momentary holding magnet after the de-energization of the magnet coil. Such sticking is caused essentially by the eddy currents in the magnetic circuit. It has been attempted to configure the magnet yoke and the armature such that the generation of eddy currents is substantially eliminated or the disadvantageous effect of such eddy currents is compensated for. The sticking period depends from numerous various parameters such as the size of the air gap between the pole face and the armature situated at the holding magnet, the force of the resetting means (which, as a rule, are mechanical springs), and accelerations affecting the setting unit. Apart from the unavoidable manufacturing tolerances, the alternating gas counter pressures affecting the cylinder valves and the acceleration forces which have an unpredictable magnitude and which act on the armature, cause irregular oscillations of the sticking period, so that after switching off the holding current, the motion start of the armature varies in an undeterminable manner. Also, the duration of motion (flying time) of the armature as well as the kinetic energy losses and thus the electric energy to be applied to the opposite (capturing) magnet depends from the momentary operational condition.

German Offenlegungsschrift (application published without examination) 195 26 681 describes a method for a timely accurate control of the armature motion of an electromagnetically operated setting arrangement of the above type in which after the lapse of a predetermined period following the switch-off of the holding current, a short current pulse of inverted polarity is applied to the magnet coil. Such a short current pulse in which the current intensity, the duration and the moment of energization are appropriately selected, may result, to be sure, in a faster decay of the magnetic field generated by the eddy currents in the magnet yoke of the electromagnet, and thus the armature is released from the pole face of the holding electromagnet in a timely accurate and reliable manner. With such an arrangement constant sticking periods for the control may be achieved. Since the eddy currents cause, particularly in the armature upon its release from the pole face, a buildup of a magnetic field which opposes the force of the resetting means affecting the armature and which delays the armature motion, the earlier-noted kinetic energy loss is eliminated. Such a loss can be compensated for only by an increased amount of electric energy applied to the capturing electromagnet if the actuator is to operate reliably and in a timely accurate manner. The short current pulse for causing a decay of the magnetic field in the electromagnet is not sufficient for such a purpose. Such disadvantages may be reduced only by an armature structured to suppress eddy currents. The residual magnetization of the magnet yoke and the armature following the switch-off of the current causes a significant energy loss which, at the capturing magnet, must be compensated for by a corresponding increase of energy input which, however, cannot be applied with the known process as an additional short current pulse.

SUMMARY OF THE INVENTION

It is an object of the invention to provide an improved method by means of which the above-described kinetic energy losses and the need for an additional energy input are significantly reduced.

This object and others to become apparent as the specification progresses, are accomplished by the invention, according to which, briefly stated, the method of increasing a cast-off speed of an armature from a pole of an electromagnet of an electromagnetic actuator, includes the following steps: holding the armature at the pole against a force of a resetting device by maintaining an electric holding current flow through a coil of the electromagnet; and launching the armature from the pole by switching off the holding current; and at a predetermined moment during a release period of the armature from the pole, passing a cast-off current for a predetermined period through the coil. The cast-off current has a polarity opposite to the polarity of the holding current.

Conventionally a counter energization in the form of a short pulse has been used to reduce the sticking period of the armature by diminishing the magnetic field in the magnet yoke to thus increase the accuracy of the moment the armature is released from the holding magnet. According to the method of the invention, the magnetic field which, upon release of the armature, also builds up in the armature due to the eddy currents and which has a braking effect, is utilized to apply additional energy to the armature in its direction of motion as a result of a timely, limited energization of the magnet coil with reversed polarity. Thus, according to the invention, the disadvantage of an armature which allows eddy currents to be generated therein is converted into an advantage. The magnetic field which in the holding phase passes through the usually eddy-current suppressing magnet yoke and the eddy-current allowing armature, also passes through the armature and the magnet yoke in a closed circuit after switching off the holding current. As a result, a magnetic force is produced which is directed opposite the force of a resetting means, usually a resetting spring, seeking to remove the armature from the pole face of the holding magnet. The eddy current suppressing design of the magnet yoke results in a much more rapid decay of the magnetic field in the magnet yoke, and the residual holding force between the magnet yoke and the armature becomes so small that the force of the resetting spring by itself is sufficient to launch the armature from the pole face of the holding magnet. The magnetic field still present in the armature has, precisely at the beginning of the armature motion, a braking effect and causes a loss in the kinetic energy.

At that moment, by means of the counter current energization according to the invention, in the eddy current suppressing magnet yoke a field of reverse polarity has already been generated, while the eddy currents in the armature still maintain a magnetic field of the previous polarity. By means of the thus oppositely oriented fields in the magnet yoke, on the one hand, and in the armature, on the other hand, there is obtained, in the same direction as the spring force, a magnetic force which affects the armature in the same direction as the force of the resetting means and results in an additional energy input for the armature which is particularly effective when the armature starts to move. The counter energization with electric current occurs only for a limited, predeterminable period in order to avoid a reverse magnetization of the armature. In this manner a high degree of efficiency for the inputted energy is obtained. Such an effect is of special interest in actuators which operate engine valves, particularly exhaust valves, in piston-type internal-combustion engines. Actuators of this type have two electromagnets between which the armature is reciprocated. The armature location at the pole face of the respective electromagnet defines the setting position. Upon opening an exhaust valve, frequently substantial electric energy has to be applied to the capturing electromagnet to ensure that the armature is at all captured, since the armature is significantly braked by the force derived from the gas pressures in the engine cylinder. Such energy has to be applied at an early moment when the armature is still at a relatively large distance from the pole face of the capturing electromagnet; this is possible only with a low degree of efficiency. The kinetic energy, applied to the armature upon release thereof from the pole face of the holding electromagnet in the opening direction, supports the force of the resetting spring and thus the acceleration of the armature is increased. The electric energy for the counter current may be applied by the current supply.

In accordance with a preferred embodiment of the invention, the armature cast-off current—which is obtained by storing the current generated during the decay of the magnetic field after switching off the holding current—is stored in an storage device, preferably a capacitor and is applied to the magnet coil by connecting the storage device to the coil. The particular advantage of the method according to the invention resides in that electric energy required for the build-up of a field effective in the opposite direction is taken from the coil proper after switching off the holding current. A storage device, particularly a capacitor, is connected in series with or parallel to the magnet coil at the moment the holding current is switched off, whereby the capacitor is charged up by the coil as in an oscillating circuit. As soon as the current reaches zero magnitude, the capacitor automatically discharges by forcing through the coil a current which flows oppositely to the original current. In this manner the desired counter energization is obtained.

According to a particularly advantageous embodiment of the invention, after discharging the storage device, the decay of the cast-off current in the coil is slowed down by a freewheeling diode without changing the polarity. Such a diode additionally ensures that after discharging the storage device, particularly a capacitor, that is, upon reaching a zero magnitude for the capacitor voltage, the reverse charging process cannot start anew, but the current slowly decays through the freewheeling diode while retaining its polarity, so that such an inverse current may be used for an extended period to maintain the magnetic field effective in the cast-off direction of the armature. By an appropriate coordination of the components, particularly the design of the magnet yoke as an eddy current suppressing element and the armature as an eddy current permitting element, it may be ensured that no repeated reverse magnetization of the armature takes place and thus a renewed attraction is prevented.

DESCRIPTION OF THE PREFERRED EMBODIMENTS

Figure 1:
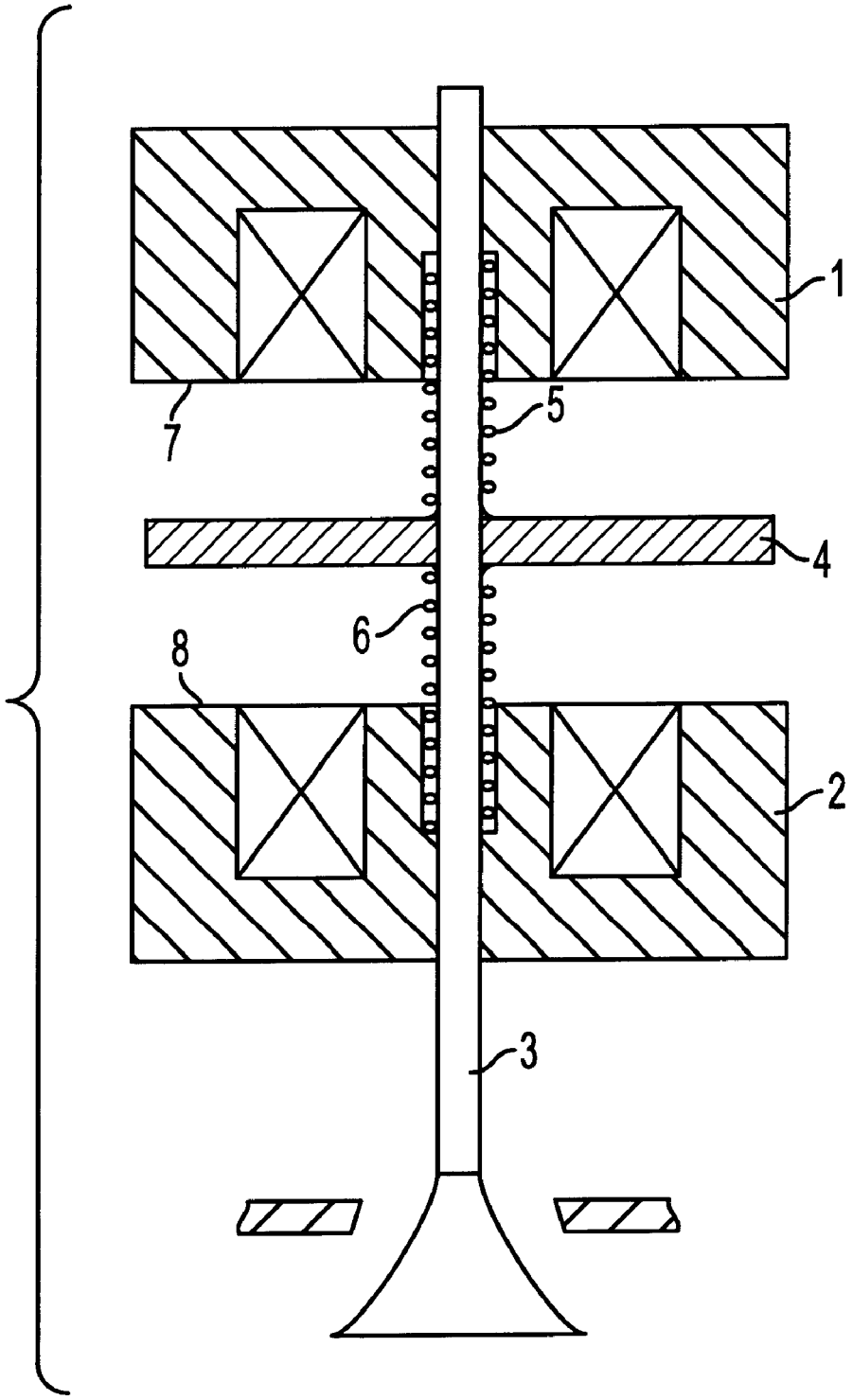
FIG. 1 is a schematic axial sectional view of an electromagnetic actuator for operating an engine valve.

FIG. 1 shows an electromagnetic actuator for operating a cylinder valve of a piston-type internal-combustion engine. The electromagnetic actuator is essentially formed of an electromagnet 1 serving as a closing magnet, an electromagnet 2 serving as an opening magnet and a cylinder valve 3 coupled with an armature 4 which may be reciprocated between the two electromagnets 1 and 2 by electromagnetic forces against the force of resetting springs 5 and 6. Dependent upon control, the armature assumes a closed position at the pole face 7 of the closing electromagnet 1 and an open position at the pole face 8 of the opening electromagnet 2.

If during operation the cylinder valve 3 is, for example, in the closed position, that is, the armature 4 lies against the pole face 7 of the electromagnet 1, the opening of the engine valve is effected by first turning off the holding current passing through the solenoid of the closing electromagnet 1 so that under the force effect of the resetting spring 5 the armature 4 is moved in the direction of the pole face 8 of the electromagnet 2. Dependent upon the magnitude of the residual electromagnetic field at the electromagnet 1, the moment of the de-energization of the holding current at the electromagnet 1 is not identical with the moment of motion start of the armature 4. Because of the "adhering" ("sticking") effect, the motion of the armature 4 starts with a delay from the moment the holding current is switched off.

Under the influence of the force of the spring 5, the armature 4, after its release from the pole face 7, passes through the mid position determined by the equilibrium between the two oppositely acting forces of the resetting springs 5 and 6, and at an appropriate moment the "capturing" current is switched on for the coil of the electromagnet 2 to counteract the resetting force of the resetting spring 6 by means of the magnetic field of the electromagnet 2, to thus safely bring the armature 4 into engagement with the pole face 8 of the electromagnet 2, and to maintain the cylinder valve 3 in its open position during an open period predetermined by the engine control. For closing the engine valve the above-described occurrences take place in a reverse order.

Figure 2:
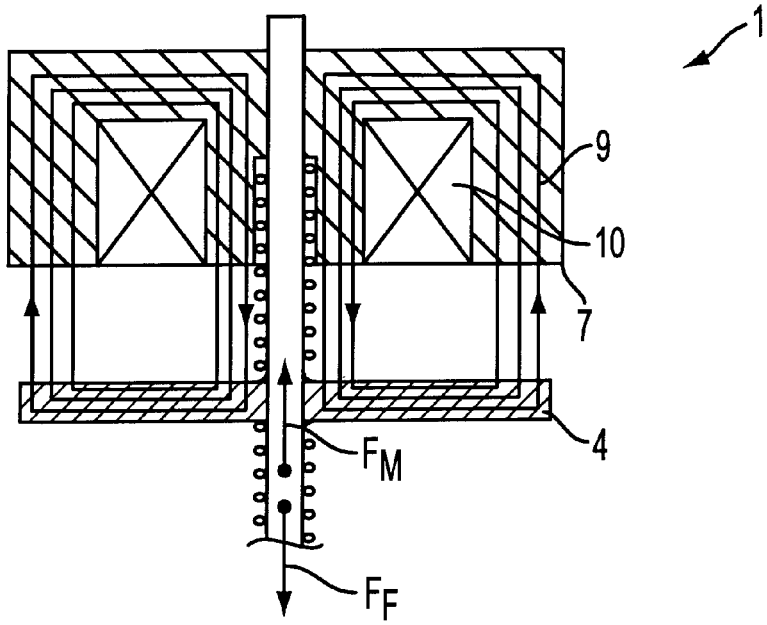
FIG. 2 (PRIOR ART)
FIG. 2 is an axial sectional view of an electromagnet of the electromagnetic actuator showing electromagnetic field lines and depicting the moment when the armature moves away from the pole face after switching off the holding current.

The closing magnet 1 shown schematically in FIG. 2 is essentially formed of a yoke body 9 which carries a coil (solenoid) 10. In the energized state of the closing magnet 1 the armature 4 engages the pole face 7; the return spring 5 is compressed. The electromagnetic field affecting the armature 4 has, indicated by its schematically shown magnetic force lines, a polarity which is maintained even after the holding current is switched off.

If the magnet yoke 9 of the electromagnet 1 has an eddy current-suppressing design, for example, it has a laminated construction, the residual magnetic field decays relatively rapidly. If, in contrast, the armature 4, by its particular shape and/or material is of the type which permits eddy currents, the magnetic field decays slower in the region of the armature 4. At a predetermined moment following the switch-off of the holding current and the successive decay of the holding magnetic field, the magnetic holding force is less than the resetting force of the resetting spring 5, so that the resetting spring 5 may move the armature 4 in the direction of the arrow F away from the pole face 7 of the closing electromagnet 1.

The residual holding magnetic field which is maintained by the eddy currents in the armature 4 acts as a magnetic force $F_M$ against the force $F_F$ of the resetting spring 5 so that the motion start of the armature 4 is delayed.

Figure 3:
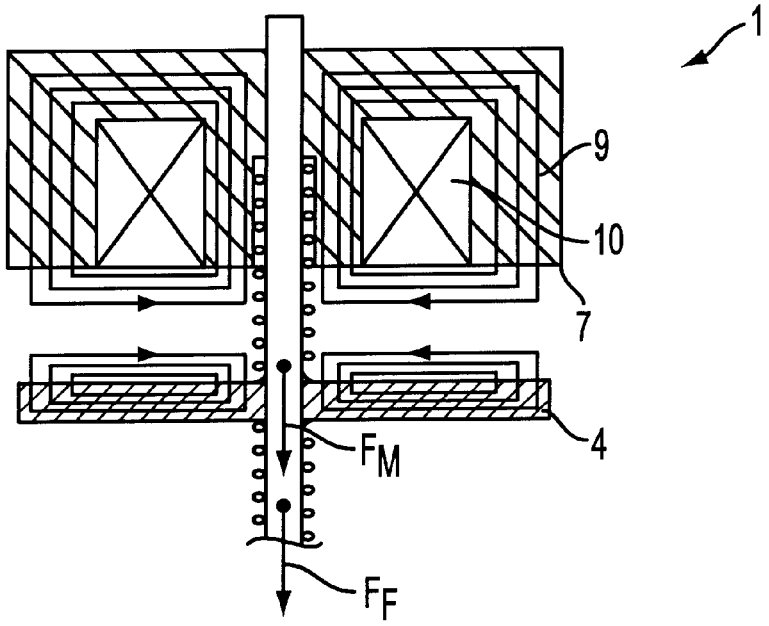
FIG. 3 is a view similar to FIG. 2 depicting the moment after a cast-off current with reversed polarity is applied to the solenoid of the electromagnet.

FIG. 3 depicts the armature 4 in the same position as in FIG. 2. If, at the moment of switching off the holding current passing through the coil 10, there is applied a current of opposite polarity to the coil 10, then in the yoke body 9 of the electromagnet 1, because of its eddy current-suppressing design, a magnetic field of reverse polarity builds up very rapidly, while the magnetic field in the armature 4 retains its earlier orientation. As a result, the force of the magnetic field of the yoke body 9 affecting the armature 4 also reverses its direction, so that the magnetic force $F_M$ will have the same direction as the force $F_F$ of the resetting spring 5. Thus, a higher energy is applied to the armature 4, resulting in a greater acceleration thereof. Accordingly, the armature 4 passes through its mid position with an increased motion energy and therefore approaches much more powerfully (rapidly) the pole face of the capturing electromagnet. Therefore, a correspondingly lesser current for the capturing energy may be needed.

Figure 4:
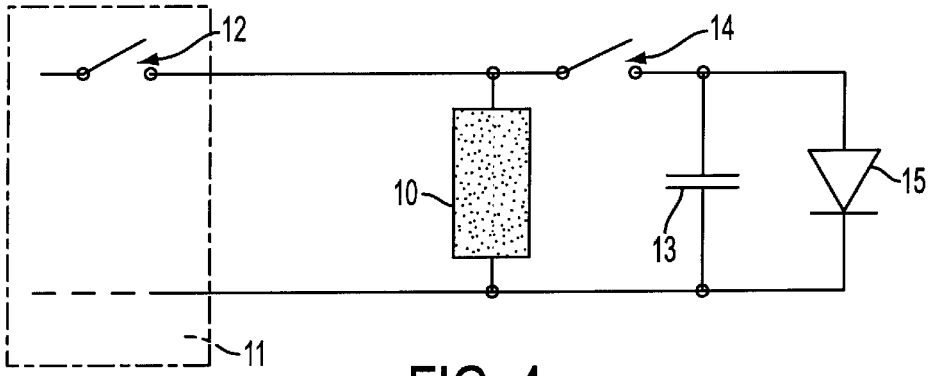
FIG. 4 is a diagram of a circuit for obtaining the cast-off current from the solenoid of the electromagnet.

FIG. 4 schematically illustrates a circuit for supplying the closing magnet 1 shown in FIG. 2 with electric current. The coil 10 of the electromagnet 1 is connected to an end stage 11 for receiving a capturing current and thereafter a holding current. The current supply from the end stage 11 to the coil 10 is turned on and off by a switch 12.

A capacitor 13 which is connected parallel to the coil 10 may be turned on and off by a switch 14. Further, a freewheeling diode 15 is connected parallel to the capacitor 13.

When the holding current is turned off by opening the switch 12, the switch 14 is simultaneously closed, so that a storage device, such as the capacitor 13 in the present example, is coupled to the circuit. Consequently, during the decay of the residual magnetic field in the coil 10 the current may be stored in the capacitor 13. As soon as the current reaches zero, the capacitor 13 discharges by forcing an electric current through the coil 10. Such a current has a polarity that is opposite to the polarity of the original current. The freewheeling diode 15 ensures that after reaching the zero voltage at the terminals of the capacitor 13, the recharging process does not start anew, but via the freewheeling diode 15 the current flowing from the coil 10 again slowly decreases without a new occurrence of a current reversal. Rather, the inverse current continues to flow for a longer period.

Figure 5:
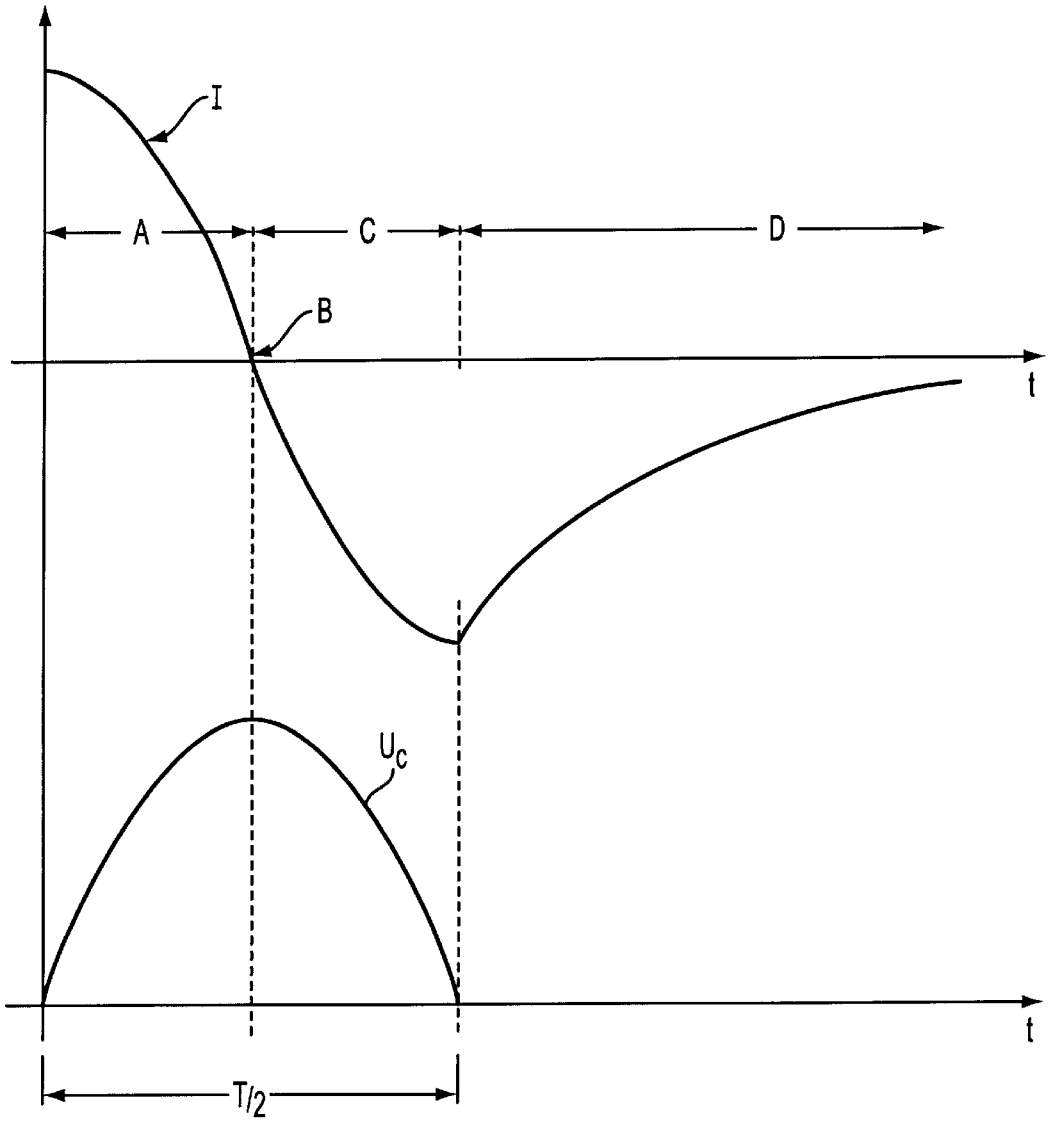
FIG. 5 is a diagram illustrating the current intensity/time function and the capacitor voltage/time function in a circuit illustrated in FIG. 4.

This sequence is illustrated in the diagram of FIG. 5, beginning with the moment of switch-off of the holding current by opening the switch 12 and with the simultaneous closing of the switch 14. During the period A the current I drops in the solenoid 10, while in the capacitor 13 the voltage $U_C$ accordingly increases until the capacitor 13 is fully charged which occurs at moment B. After moment B the capacitor discharges during the period C, whereby a current of reverse polarity flows through the coil 10 until the voltage $U_C$ again reaches zero value at the terminals of the capacitor 13.

By virtue of the freewheeling diode 15 the current in the coil 10 slowly decreases towards the zero value in the course of period D. During period D the polarity of the magnetic field which repels the armature and which is generated by the armature cast-off current, continues to be maintained.

The dimensioning of the capacitor 13 may be determined from the formulae for the desired counter voltage. By using the energy conservation formulae and the individual formulae $E=\frac{1}{2}LI^2$ and $E=\frac{1}{2}CU^2$, from the holding current, the coil inductivity and the desired voltage U the approximate capacity may be calculated as $C=L\times I^2/U^2$. The period for the first half wave T/2 is then obtained as $T/2=\pi\times L\times I/U$.

In the illustrated circuit the switches 12 and 14 are only symbolically shown as simple switches; in practice preferably semiconductor switches are used. Also, other types of electronic circuits may find application in the alternative, as long as they store the coil current and ensure the desired counter current effect.

Figure 6:
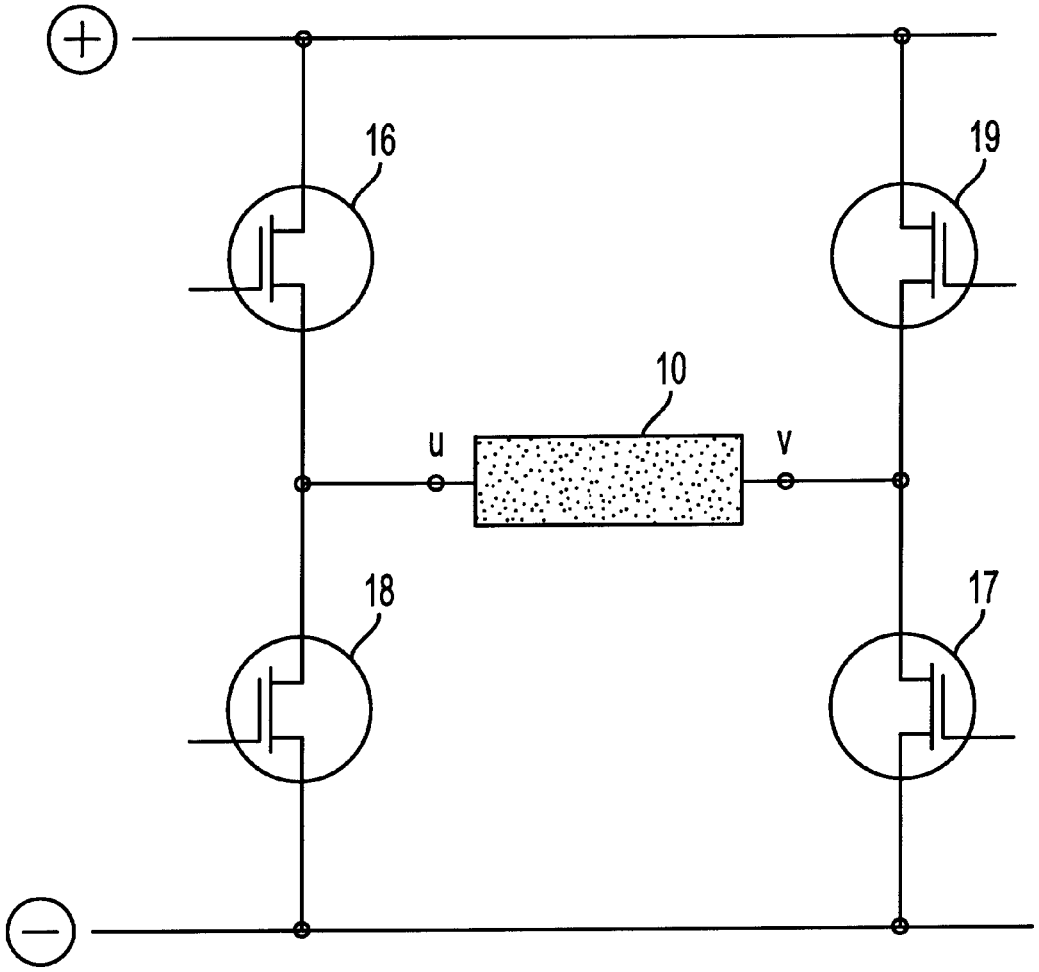
FIG. 6 is a diagram of a circuit for applying a counter current to the coil of the electromagnet from the current supply.

FIG. 6 shows a circuit constituting a "bridge end stage" which makes possible to supply the counter current to the coil 10 from the supply voltage. For the "normal" energization of the coil 10 both transistor switches 16 and 17 are closed, whereby current flows from point u to point v through the coil 10. The intensity of the current is determined by the preset regulating data; as a rule, the capturing current has a greater intensity than the holding current which is passed through the coil after the armature 4 has arrived in engagement with the pole face of the magnet.

The transistor switches 16, 17 are turned off (opened) for initiating movement of the armature 4 in the direction of the opposite, capturing magnet by the force of the respective resetting spring.

To produce a counter current, the transistor switches 18, 19 are turned on (closed) so that electric current flows in the opposite direction through the coil 10, that is, from point v to point u. This occurs at least when the current, that has flowed in the original direction, has been decreased to zero, since the current may not change in a coil in an abrupt manner. The reduction of the original current may be in principle used for energy-saving purposes by feeding it back through the bridge to the "supply network". It is also feasible, however, to integrate a high-voltage freewheel or a normal freewheel into the circuit.

Whether an energization occurs via a storage device as described in connection with FIGS. 4 and 5 or from a supply network as described in connection with FIG. 6, in practice the corresponding actuator is structurally verified concerning its characteristic electric and magnetic properties so that for the control of the electromagnets, both for the capturing phase, that is, the control of the capturing and holding current and for the cast-off phase, that is, for the counter current, appropriate empirical values are available which make it possible to turn on the counter current after a certain delay following the turn-off of the holding current. The counter current may be added as early as the period when the armature still engages the pole face of the holding magnet to ensure that based on the inductive effect, a sufficient counter field may build up in the coil in a timely manner. The time period which is of importance for the method according to the invention from the energy point of view, however, occurs after the motion start, that is, the counter field has to be fully effective when the armature is in its first motion phase so as to effect a corresponding conversion into kinetic energy by launching the armature from the pole face.

Conventional armature designs which, based on their material and their construction, favor eddy currents, are sufficient to utilize the heretofore disadvantageous properties and to turn them into an advantage for increasing the energy feed to generate kinetic energy. Dependent upon the field of application it may be expedient to apply additional structural measures to the armature such that upon turning off the holding current, strong eddy currents and thus a strong counter field is built up in the armature. Such measures may include, for example, the addition of copper and/or aluminum inserts to the iron body of the armature.

It will be understood that the above description of the present invention is susceptible to various modifications, changes and adaptations, and the same are intended to be comprehended within the meaning and range of equivalents of the appended claims.

What is claimed is:

1. A method of increasing a cast-off speed of an armature from a pole of an electromagnet of an electromagnetic actuator, comprising the following steps:

(a) producing a first magnetic field for holding the armature at said pole against a force of a resetting device by maintaining an electric holding current through a coil of said electromagnet; and (b) launching the armature from said pole by (1) switching off said holding current; and (2) at a predetermined moment during a release period of the armature from said pole, producing a second magnetic field by passing a cast-off current for a predetermined period through said coil; said cast-off current having a polarity opposite to the polarity of said holding current, whereby said first and second magnetic fields have opposite polarities.

2. The method as defined in claim 1, further comprising the step of storing a current, produced by a decay of an electromagnetic field after switching off said holding current, in a storage device and applying the stored current to said coil as said cast-off current by discharging said storage device.

3. The method as defined in claim 2, further comprising the step of slowing down a decay of said cast-off current after discharge of said storage device by passing said cast-off current through a freewheeling diode without change of polarity.

4. The method as defined in claim 1, further comprising the steps of suppressing eddy currents in a yoke of said electromagnet and permitting eddy currents in said armature.

* * * * *